US005110219A

United States Patent [19]

Lopes

[11] Patent Number: 5,110,219

[45] Date of Patent: May 5, 1992

[54] COMBINATION BEACH MAT/TOTE BAG

[76] Inventor: Rui P. Lopes, 253 Bear Paw Rd., Bridgeport, Conn. 06606

[21] Appl. No.: 697,795

[22] Filed: May 9, 1991

[51] Int. Cl.[5] ..... B65D 30/10; A47G 9/06

[52] U.S. Cl. ..... 383/4; 383/6; 190/2; 5/417; 5/419

[58] Field of Search ..... 383/6, 4; 190/1, 2; 5/417, 418, 419, 420

[56] References Cited

U.S. PATENT DOCUMENTS

| | | | |
|---|---|---|---|
| 1,721,571 | 7/1929 | Miller | 5/419 X |
| 2,603,264 | 7/1952 | Cautley | 383/4 X |
| 2,898,609 | 8/1959 | Storie | 5/344 |
| 4,164,275 | 8/1979 | Davis | 190/42 |
| 4,231,125 | 11/1980 | Tittl | 5/419 |
| 4,273,380 | 6/1981 | Silvestri | 297/191 |
| 4,466,516 | 8/1984 | Sicoli et al. | 190/2 |
| 4,468,810 | 8/1984 | Longo | 383/3 |
| 4,499,133 | 2/1985 | Prince | 383/4 X |
| 4,512,049 | 4/1985 | Henry | 5/417 |
| 4,516,668 | 5/1985 | Grayek | 190/2 |
| 4,546,507 | 10/1985 | Weinstein | 5/419 |
| 4,604,765 | 8/1986 | Schultz | 383/4 X |
| 4,682,447 | 7/1987 | Osborn | 383/4 X |
| 4,687,248 | 8/1987 | Ross et al. | 297/129 |
| 4,703,528 | 11/1987 | Rolle | 190/2 X |
| 4,709,430 | 12/1987 | Nicoll | 383/4 X |
| 4,723,300 | 2/1988 | Aranow | 383/4 |
| 4,856,912 | 8/1989 | Damus et al. | 383/4 |
| 4,915,232 | 4/1990 | Hill et al. | 206/541 |
| 4,991,245 | 2/1991 | Franco | 5/419 |
| 4,991,978 | 2/1991 | Ostrowski | 383/4 |

FOREIGN PATENT DOCUMENTS

| | | | |
|---|---|---|---|
| 203221 | 12/1986 | European Pat. Off. | 5/417 |
| 761135 | 1/1934 | France . | |
| 1264919 | 2/1972 | United Kingdom | 383/4 |

*Primary Examiner*—Stephen Marcus
*Assistant Examiner*—Jes F. Pascua
*Attorney, Agent, or Firm*—DeLio & Associates

[57] ABSTRACT

A combination beach mat/tote bag made of a sheet of terry cloth or other fabric having a pair of opposed side edges and a pair of opposed end edges, the sheet preferably being of rectangular shape. A flexible strap is attached to the sheet at the corners, and each strap has an anchor pod secured on a distal end thereof. The sheet has a handle at each of the end edges and zippers along each of the side edges. The sheet is adapted to be folded in half along a line between the side edges such that the side and end edges are superimposed and the side edges zipped up to form an open top tote bag which may be carried by the handles. The sheet is further adapted to be unzipped, unfolded and spread on a beach surface and the anchors buried below the beach surface to secure the sheet. The anchor pad is releasably secured to the strap by a snap fastener, and the snap fasteners on adjacent straps at the end edges may be further fastened to each other to form the handles. Each strap also includes a fastener for removably securing the anchor directly to the sheet. An inflatable head rest may be removably secured to the sheet near one end.

16 Claims, 2 Drawing Sheets

COMBINATION BEACH MAT/TOTE BAG

BACKGROUND OF THE INVENTION

This invention is directed to a combination mat/tote bag which may be converted from a tote bag for carrying articles to a lounging mat which may be spread on the ground or beach surface.

When preparing to embark on a visit to the beach or other recreation area, people often bring along a tote bag or other container for carrying various items, along with a mat or other type of sheet to spread on the beach or other ground surface for sitting or reclining. Attempts have been made to provide combination carrying bags and beach mats in order to reduce the number of items to be carried since there is may be a good deal of walking involved before arriving at the final destination. An example of such combination mat/bag is disclosed in U.S. Pat. No. 4,468,810. It is desirable to have such a combination mat/bag which is lightweight and easy to convert to its intended use as a tote bag. The article should be sturdy, easy to clean and care for, and able to carry the desired quantity of items in relative comfort.

It is also desirable that the bag be easily opened up and converted to its use as a mat when the user arrives at his or her destination, and that the mat be comfortable for both sitting and reclining. Additionally, there should be a way of securely the mat to the ground in order to prevent the mat from blowing away in the wind or otherwise being disturbed. One particular method which uses anchoring pins has been disclosed in U.S. Pat. No. 4,466,516. However, this solution is not entirely satisfactory since the pins are stored separately and must be located and secured to the mat every time they are used. They may also become separated from the mat when not in use and become lost.

Bearing in mind the problems and deficiencies of the prior art, it is therefore an object of the present invention to provide a combination mat/tote bag for use at the beach or other outdoor recreation areas.

It is another object of the present invention to provide a combination mat/tote bag which may be easily converted between its intended uses.

It is a further object of the present invention to provide a combination mat/tote bag which has means for securing the mat to the ground, which means are easy to access and not easily separated from the mat and lost.

It is yet another object of the present invention to provide a combination mat/tote bag which is sturdy yet easily cleaned and otherwise cared for so that it has a long life.

SUMMARY OF THE INVENTION

The above and other objects, which will be apparent to those skilled in the art, are achieved in the present invention which comprises a combination mat/tote bag for use at the beach made of a sheet of flexible, foldable material such as terry cloth or other fabric having a pair of opposed side edges and a pair of opposed end edges, the sheet preferably being of rectangular shape. A flexible strap is attached to the sheet adjacent each of the side and end edges, and each strap has an anchor secured on a distal end thereof. The sheet has a handle at each of the end edges and fasteners along each of the side edges. The sheet is adapted to be folded in half along a line between the side edges such that the side and end edges are superimposed and the side edges fastened to form an open top tote bag which may be carried by the handles. The sheet is further adapted to be unfastened, unfolded and spread on a beach surface and the anchors buried below the beach surface to secure the sheet.

The anchor used preferably comprises a pod releasably secured to the strap by a fastener, such as a snap, and the snap fasteners on adjacent straps at the end edges may be further fastened to each other to form the handles. Each strap may also include a fastener for removably securing the anchor directly to the sheet. An inflatable head rest may be removably secured to the sheet near one end. The fasteners on the sheet side edges preferably comprise slide fasteners such as zippers which may be openable from either end. A fastener may be provided for further folding the tote bag along a line between the side edges of the sheet and superimposing and releasably securing the lower end of the bag against the upper end.

DETAILED DESCRIPTION OF THE INVENTION

A preferred embodiment of the present invention is depicted in FIGS. 1–8 in which like numerals refer to like features of the invention.

The invention comprises a combination mat/tote bag 10 which is primarily made of a blanket type material such as terry cloth or other soft, flexible and foldable material. The sheet 12 material used in construction of the combination mat/tote bag should be sturdy enough to hold up under repeated uses, yet should be preferably made of a material which is easily washable and cared for to insure long life and usage.

Figure 1:
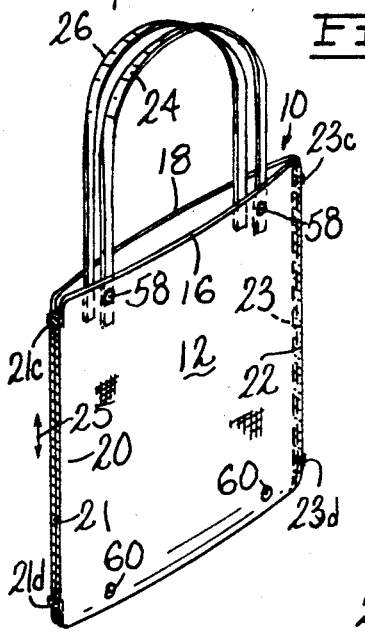
FIG. 1 is perspective view of the preferred embodiment of the invention in its intended use as a tote bag.

As shown in FIG. 1 in its form as a tote bag, a single rectangular sheet 12 of terry cloth is shown folded in half along a fold line 14 extending between the long side edges 22, 24 of the sheet so that the side and end edges are superimposed on one another. Zippers or other slide fasteners 21, 23 are provided to close and secure the side edges of sheet 12. The zippers 21, 23 are of the double ended type, that is they each include a pair of zipper pulls **21*c,d* and 23*c,d* which permit the zipper to be opened from either end, as indicated by arrow 25, to gain access at either the top or bottom of the bag. The opposed end edges 16, 18 are left unsecured to form an open top tote or carrying bag. Handles 24, 26 made of flexible heavy duty canvas straps are sewn, riveted or otherwise permanently secured to the ends 16, 18 respectively near the corners adjacent the side and end edges and form loops for easy carrying of the combination mat/tote bag 10**.

Figure 2:
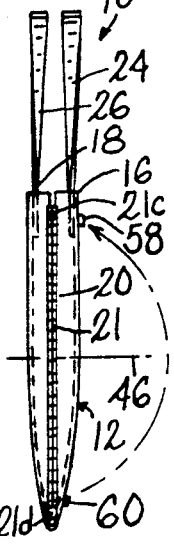
FIG. 2 is an end elevational view of the embodiment depicted in FIG. 1.
Figure 3:
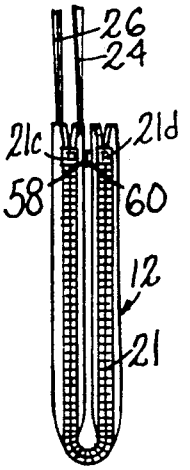
FIG. 3 is an end elevational view of the embodiment depicted in FIG. 2 with the lower half of the bag folded up and secured to the upper half of the bag.

As depicted in FIGS. 2 and 3, complimentary releasable snap fasteners 58 (on the top of the bag at the handle) and 60 (at the bottom of the bag) are provided on one side of the bag so that, if necessary, it may be folded in half along fold line 46 which extends between the long side edges 20, 22 of the sheet to superimpose the lower end of the bag upward against the upper end to further reduce its height. Preferably, the sheet 12 has a full length of about 60 inches and a width of about 26 inches to provide a suitable area for sitting or reclining when it is used as a mat. Such dimensions would give a bag as depicted in FIGS. 1 and 2 a height of about 30 inches and width of 26 inches. When further folded as shown in FIG. 3, the bag would have a height of about 15 inches.

Figure 4:
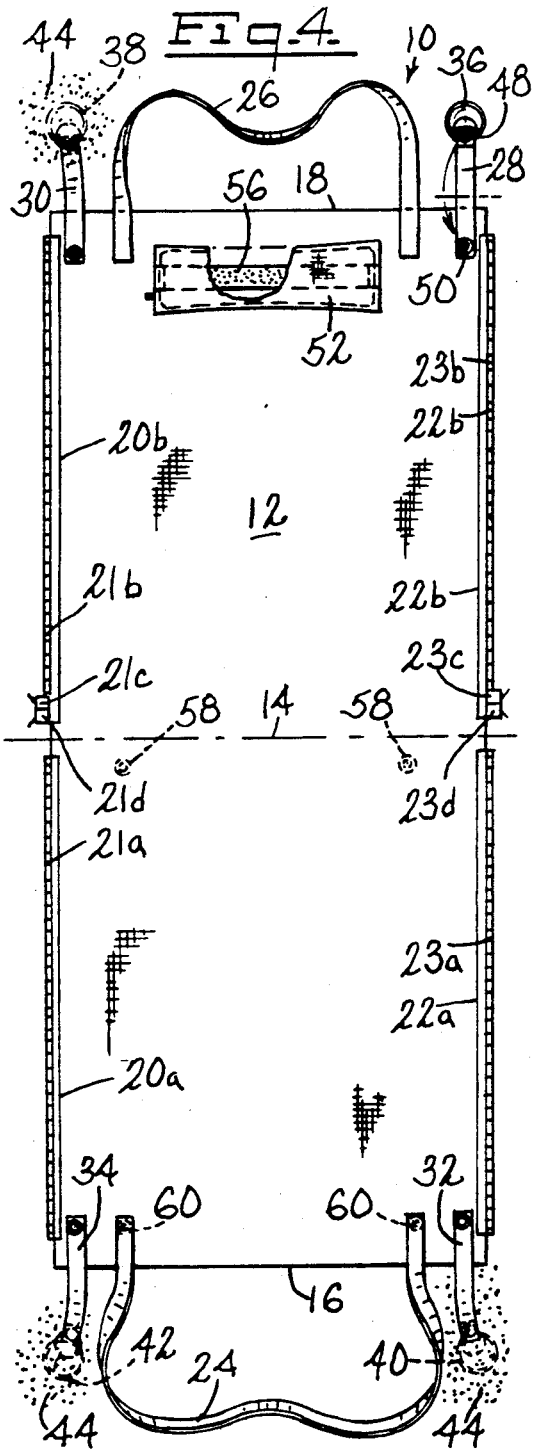
FIG. 4 is a plan view, partially cut away, showing the embodiment of FIG. 1 in its use as a mat.

FIG. 4 depicts the invention 10 in its use as a mat. In converting from the bag depicted in FIGS. 1 and 2, the side edges 20*a,b* and 22*a,b* are unfastened by unzipping zipper pulls 21*c,d* and 23*c,d* downward until the zipper sections 21*a,b* and 23*a,b* are fully separated and released, and thereafter unfolding sheet 12 and spreading it out to its full size. To prevent sheet 12 from blowing away or otherwise being disturbed, there are provided identical straps 28, 30, 32, 34 at the four corners adjacent the side and end edges of sheet 12. These straps are flexible and preferably made of fabric, more preferably a type of canvas similar to that used for the handles.

Straps 28, 30, 32, 34 are sewn or otherwise permanently secured near the corners of sheet 12. On the distal end of the straps there is provided flat, disc shaped anchor pods 36, 38, 40, 42 which are adapted to be buried as shown below the surface of the beach or other ground 44 to secure the mat. Each anchor pod may be of any desired shape, for example, circular, square or hex shaped, and should be preferably of a width or diameter of 1¼" or more, preferably 2", in order to ensure that it may be easily buried, yet securely hold the corner of the sheet against the ground.

Figure 5:
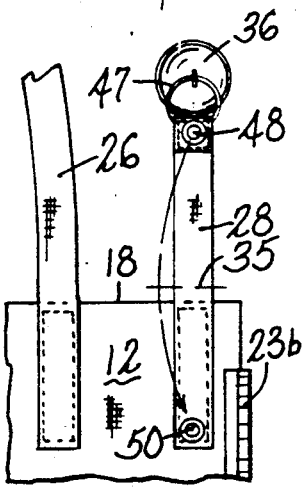
FIG. 5 is a close-up view of the features in the upper left corner of the mat depicted in FIG. 4, showing the strap and anchor pod in their extended form.
Figure 7:
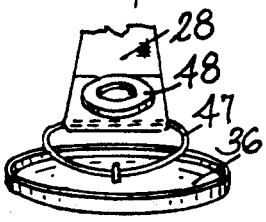
FIG. 7 is a close-up perspective view of the end of the strap and anchor pod shown in FIG. 5.
Figure 6:
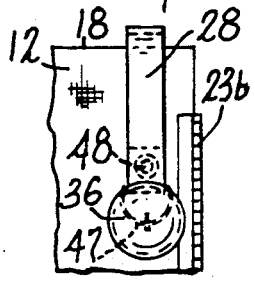
FIG. 6 is another close-up view of the upper left corner of the mat depicted in FIG. 4, showing the strap end and anchor pod secured directly against the mat by a fastener.

As shown in detail in FIGS. 5, 6 and 7 in connection with strap 28, a releasable snap fastener 48 is provided at the distal end to loop around and secure the ring 47 attached to anchor pod 36. Snap fastener 48 may be opened to remove the anchor while the combination mat/tote bag 10 is washed. Furthermore, to hold anchor 36 securely against and directly to the sheet material without dangling when the anchor is not needed, for example, when the invention is in its tote bag form, strap 28 may be folded down along fold line 35 to removably secure snap fastener 48 against complimentary fastener 50 at the end of the strap secured to sheet 12. The other straps and anchors have comparable fasteners to those fasteners 48 and 50 depicted in FIGS. 5–7.

Figure 9A:
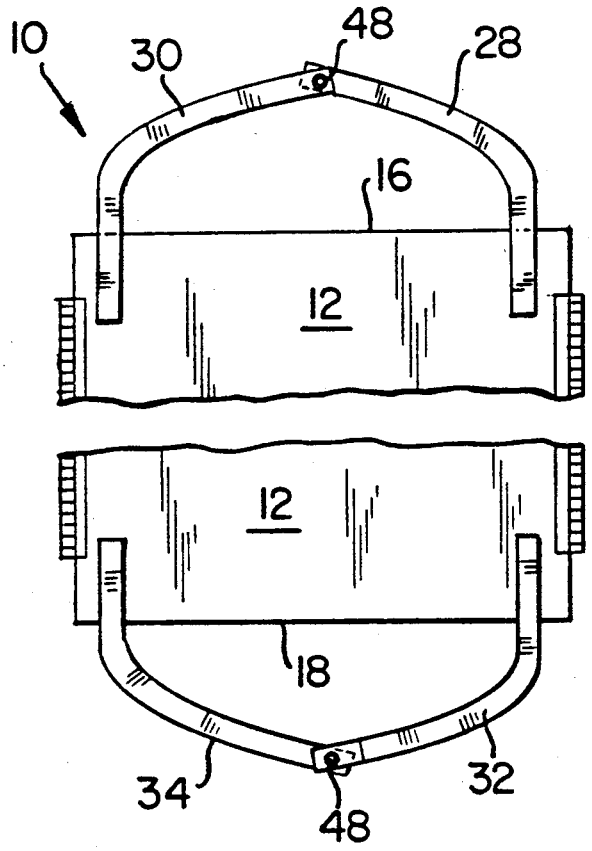
FIGS. 9A and 9B are plan views depicting alternate embodiments of the handles for the invention.
Figure 9B:
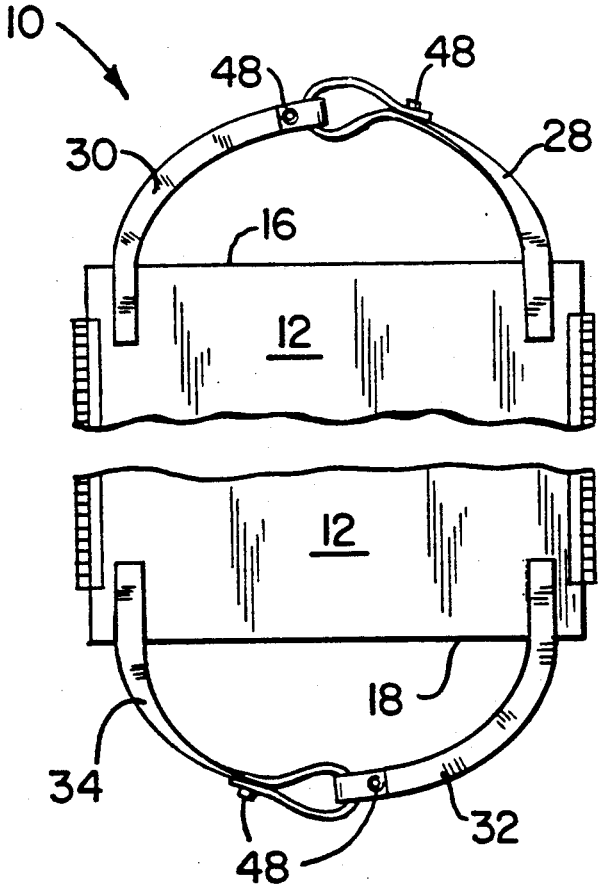

In an alternate embodiment shown in FIGS. 9A and 9B, the handles at the opposite ends 16 and 18 of sheet 12 may be formed by the anchor straps themselves. In this instance, anchor straps 28, 30, 32, 34, which are normally of length of about 5', may be lengthened and the distal ends thereof connected at each end by means of the snap fasteners (FIG. 9A) or loops (FIGS. 9B) discussed above. In such embodiment, straps 28 and 30 may be connected to form a handle on one end of sheet 12 while straps 32 and 34 may be connected to form the handle at the other end of the sheet.

Figure 8:
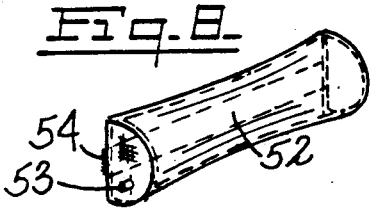
FIG. 8 is a perspective view of the inflatable head rest depicted on the mat in FIG. 4.

To provide additional comfort when the user wishes to recline on mat 10, a head rest 52 inflatable with air through valve stem 53 is provided. As shown in FIGS. 4 and 8, head rest 52 is removably secured to sheet 12 by complimentary strips 54, 56 of Velcro-type hook and loop synthetic materials which adhere when pressed together.

Thus, the present invention provides a sturdy yet easy to manufacture combination mat/tote bag which meets the objects recited above. While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A combination mat/tote bag comprising:

a sheet made of flexible, foldable material having a pair of opposed side edges and a pair of opposed end edges;

a flexible strap attached to said sheet adjacent each of said side and end edges, each strap having a disc shaped anchor pod secured on a distal end thereof;

a handle at each of said end edges; and fasteners along each of said side edges, said sheet adapted to be folded along a line between said side edges such that said side and end edges are superimposed and said side edges fastened to form an open top tote bag which may be carried by said handles, said sheet further adapted to be unfastened, unfolded and spread on the ground and said anchors buried below the ground surface to secure said sheet.

2. The combination of claim 1 further including a head read removably secured to said sheet near one end thereof.

3. The combination of claim 1 wherein said head rest is inflatable.

4. The combination of claim 1 wherein said fasteners on said sheet side edges comprise zippers.

5. A combination beach mat/tote bag comprising:

a rectangular sheet made of flexible material, said sheet being foldable at the middle to superimpose one half of said sheet on the other;

a pair of zippers along opposite side edges on said sheet closable when said sheet is folded to form an open top tote bag;

a handle attached to each end of said sheet for carrying said tote bag;

a flexible fabric strip attached to said sheet near each corner;

an anchor on the distal end of each strap for burying below the beach surface when said sheet is unfolded and spread out to secure said sheet on said beach surface; and a fastener on each strap for removably securing said anchor directly to said sheet during use as the tote bag.

6. The combination of claim 5 wherein said anchor comprises a pod releasably secured to said strap by a fastener.

7. The combination of claim 5 wherein said zippers are openable from each end thereof.

8. A combination beach mat/tote bag comprising:

a sheet made of flexible, foldable material having a pair of opposed side edges and a pair of opposed end edges;

a flexible strap attached to said sheet adjacent each of said side and end edges, each strap having an anchor secured on a distal end thereof and a fastener for removably securing said anchor and strap distal end directly to said sheet;

a handle at each of said end edges; and fasteners along each of said side edges, said sheet adapted to be folded along a line between said side edges such that said side and end edges are superimposed and said side edges fastened to form an open top tote bag which may be carried by said handles, said sheet further adapted to be unfastened, unfolded and spread on a beach surface and said anchors buried below the beach surface to secure said sheet.

9. The combination of claim 8 wherein said anchor comprises a pod releasably secured to said strap by a fastener.

10. The combination of claim 8 further including an inflatable head rest removably secured to said sheet near one end thereof.

11. The invention combination of claim 8 wherein said fasteners on said sheet side edges comprise zippers.

12. The combination of claim 8 further including a fastener for further folding said tote bag along a line between the side edges of said sheet and superimposing and releasably securing the lower end of the bag against the upper end thereof.

13. A combination mat/tote bag comprising:

a sheet made of flexible, foldable material having a pair of opposed side edges and a pair of opposed end edges;

a flexible strap attached to said sheet adjacent each of said side and end edges, each strap having an anchor secured on a distal end thereof, said anchor comprising a pod releasably secured to said strap by a fastener;

a handle at each of said end edges; and fasteners along each of said side edges, said sheet adapted to be folded along a line between said side edges such that said side and end edges are superimposed and said side edges fastened to form an open top tote bag which may be carried by said handles, said sheet further adapted to be unfastened, unfolded and spread on the ground and said anchors buried below the ground surface to secure said sheet.

14. A combination mat/tote bag comprising:

a sheet made of flexible, foldable material having a pair of opposed side edges and a pair of opposed end edges;

a flexible strap attached to said sheet adjacent each of said side and end edges, each strap having an anchor secured on a distal end thereof, said anchor comprising a pod secured to said strap by a snap fastener on the end of the strap, the snap fasteners on adjacent straps at said end edges being further fastenable to each other to form handles at each of said end edges; and fasteners along each of said side edges, said sheet adapted to be folded along a line between said side edges such that said side and end edges are superimposed and said side edges fastened to form an open top tote bag which may be carried by said handles, said sheet further adapted to be unfastened, unfolded and spread on the ground and said anchors buried below the ground surface to secure said sheet.

15. A combination mat/tote bag comprising:

a sheet made of flexible, foldable material having a pair of opposed side edges and a pair of opposed end edges;

a flexible strap attached to said sheet adjacent each of said side and end edges, each strap having an anchor secured on a distal end thereof, each strap further including a fastener for removably securing said anchor directly to said sheet;

a handle at each of said side edges, said sheet adapted to be folded along a line between said side edges such that said side and end edges are superimposed and said side edges fastened to form an open top tote bag which may be carried by said handles, said sheet further adapted to be unfastened, unfolded and spread on the ground and said anchors buried below the ground surface to secure said sheet.

16. A combination mat/tote bag comprising:

a sheet made of flexible, foldable material having a pair of opposed side edges and a pair of opposed end edges;

a flexible strap attached to said sheet adjacent each of said side and end edges, each strap having an anchor secured on a distal end thereof;

a handle at each of said end edges; and fasteners along each of said side edges comprising zippers openable from each end thereof, said sheet adapted to be folded along a line between said side edges such that said side and end edges are superimposed and said side edges fastened to form an open top tote bag which may be carried by said handles, said sheet further adapted to be unfastened, unfolded and spread on the ground and said anchors buried below the ground surface to secure said sheet.

* * * * *

UNITED STATES PATENT AND TRADEMARK OFFICE

CERTIFICATE OF CORRECTION

PATENT NO. : 5,110,219

DATED : May 5, 1992

INVENTOR(S) : Rui Lopes

It is certified that error appears in the above-identified patent and that said Letters Patent is hereby corrected as shown below:

Column 3, line 65, "5'" should read --5"--.

Column 3, Line 67, "Figs 9B" should read -- Fig. 9B --.

Column 4, Claim 2, Line 42, "head read" should read -- head rest --.

Column 5, Claim 5, Line 54, "on said should read -- of said --.

Column 4, Claim 5, Line 57, "strip" should read -- strap --.

In The Abstract:

Line 15, "pad" should read -- pod --.

Signed and Sealed this

Fifth Day of October, 1993

Bruce Lehman

*Attest:*

BRUCE LEHMAN

*Attesting Officer*

*Commissioner of Patents and Trademarks*